US007628181B2

(12) United States Patent
Nicodem et al.

(10) Patent No.: US 7,628,181 B2
(45) **Date of Patent: *Dec. 8, 2009**

(54) APPARATUS FOR REFILLING INKJET CARTRIDGES AND METHODS THEREOF

(76) Inventors: Harry Nicodem, 2315 N. Woodlawn Park Ave., McHenry, IL (US) 60051; Timothy Knecht, 409 Gregg La., Buffalo Grove, IL (US) 60089

( * ) Notice: Subject to any disclaimer, the term of this patent is extended or adjusted under 35 U.S.C. 154(b) by 19 days.

This patent is subject to a terminal disclaimer.

(21) Appl. No.: 12/025,487

(22) Filed: Feb. 4, 2008

(65) Prior Publication Data

US 2008/0122879 A1 May 29, 2008

Related U.S. Application Data

(63) Continuation of application No. 11/463,995, filed on Aug. 11, 2006, now abandoned, which is a continuation of application No. 10/918,307, filed on Aug. 13, 2004, now Pat. No. 7,089,973.

(60) Provisional application No. 60/495,262, filed on Aug. 14, 2003.

(51) Int. Cl.
*B65B 1/30* (2006.01)

(52) U.S. Cl. ..... 141/198; 141/9; 141/83; 141/234; 141/369; 347/86

(58) Field of Classification Search ..... 141/2, 141/9, 18, 83, 94, 95, 100, 198, 234, 367–373, 141/379; 347/29, 30, 36, 84–87
See application file for complete search history.

(56) References Cited

U.S. PATENT DOCUMENTS

| | | | | |
|---|---|---|---|---|
| 2,086,643 | A | 7/1937 | Shearer | |
| 5,704,403 | A | 1/1998 | Schwenk et al. | |
| 5,845,682 | A | 12/1998 | Hayao | |
| 5,963,135 | A | 10/1999 | Van Marcke | |
| 5,995,788 | A | 11/1999 | Baek | |
| 6,332,481 | B1 | 12/2001 | Shinada et al. | |
| 6,729,360 | B2 * | 5/2004 | Sesek et al. | 141/2 |
| 6,745,581 | B2 | 6/2004 | King et al. | |
| 6,945,640 | B2 | 9/2005 | Cheok | |
| 7,089,973 | B2 * | 8/2006 | Nicodem et al. | 141/18 |
| 2003/0191878 | A1 | 10/2003 | Shirley | |
| 2004/0263569 | A1 | 12/2004 | Ros et al. | |
| 2004/0263589 | A1 | 12/2004 | Ansier et al. | |
| 2005/0034777 | A1 | 2/2005 | Nicodem et al. | |
| 2006/0109320 | A1 | 5/2006 | Cutler et al. | |
| 2007/0052740 | A1 | 8/2007 | Guhse et al. | |

* cited by examiner

*Primary Examiner*—Timothy L Maust
(74) *Attorney, Agent, or Firm*—Vedder Price PC

(57) ABSTRACT

An integrated inkjet-cartridge refilling system that is comprised of an arrangement of mechanical, electrical, electronic, pneumatic, and software elements, which is used by an operator in a retail environment to automatically connect one of many types of inkjet cartridges that are used in printing devices and refill the cartridge.

14 Claims, 12 Drawing Sheets

APPARATUS FOR REFILLING INKJET CARTRIDGES AND METHODS THEREOF

RELATED CO-PENDING APPLICATION

This application is a continuation of co-pending U.S. application Ser. No. 11/463,995 filed Aug. 11, 2006, which is a continuation of U.S. patent application Ser. No. 10/918,307 filed Aug. 13, 2004 (now U.S. Pat. No. 7,089,973), which claims the benefit of U.S. Provisional Patent Application No. 60/495,2662 filed Aug. 14, 2003, each having as inventors Harry Nicodem and Timothy Knecht, and owned by instant Assignee, and the entirety of which applications are incorporated herein by this reference. The instant application is also related to co-pending U.S. patent application Ser. No. 11/379,717 filed Apr. 21, 2006 and owned by the instant Assignee.

FIELD OF THE PRESENT INVENTION

The present invention generally relates to an apparatus and methods for refilling printer cartridges. In particular, the present invention is directed to an automated machine or station for refilling empty or near-empty inkjet cartridges for use in printing devices and methods to automatically refill empty or near-empty inkjet cartridges.

BACKGROUND OF THE INVENTION

Printing devices, such as printers for use with computers, facsimile machines and copiers, are typically sold with at least one, and in many cases, multiple ink cartridges. These cartridges include a housing that contains a reservoir of printing ink, either black or color, along with printer nozzles, which allow the ink to be transmitted to the intended medium, and electrical contacts for communicating with the cartridge.

Many such cartridges are intended to be disposable; when the cartridge is exhausted of ink, of course, printing becomes impossible. The emptied cartridge must be removed and a replacement cartridge must be substituted therefor to enable further printing. The disposable cartridge must then be disposed of in a proper fashion to reduce spillage of any remaining ink and to reduce any potential adverse environmental impact of the ink and other materials of the cartridge. Unless properly recycled, disposing of the empty cartridge increases the amount of garbage added to landfills.

In reaction to the negative environmental impact of disposable cartridges, refillable cartridges have been developed and welcomed by the marketplace. At present, these refillable cartridges are refillable by the consumer by purchasing a refill kit including a syringe filled with ink and needle. In use, the cartridge is refilled by insertion of the needle into a refill port provided through the housing of the cartridge and emptying the syringe of ink into the reservoir of the cartridge. In practice, this is a less than ideal solution.

Often, the refilling of a refillable cartridge is accompanied by some spillage of ink. The process can therefore be messy as well as time-consuming. Furthermore, the introduction of ink by way of the syringe and needle also tends to introduce unwanted pressure into the cartridge, which causes ink to be expelled through the inkjet printing head portion of the cartridge. In some cases, combining the remaining ink with the new ink may cause unwanted color variations and other inconsistencies. After refilling, many so-called refillable cartridges are rendered unusable.

Many cartridge manufacturers allow customers to return their empty cartridges to the manufacturer. The manufacturer then refills the cartridge and resells the refilled cartridge for a discounted price. Further, many companies obtain empty cartridges, refill them with ink and sell the refilled cartridges for a discounted price, creating competition and lower prices. However, refilling an empty cartridge is the least expensive alternative, with the least amount of waste.

There are numerous printer manufacturers, such as Hewlett Packard, Lexmark, Canon, etc., and each manufactures multiple cartridges for the many printing devices. Each cartridge has a housing that contains a number of electrical contacts and print nozzles in various configurations, and is designed or configured such that it may only fit into a particular printing device and no other.

In use, the cartridges are properly inserted into a printing device which receives a signal in order to print on the medium. For example, a printer connected to a computer may receive a print signal from the computer, while a facsimile machine may receive a signal over a telephone line. The printing device converts that signal, depending on its driver program, and sends the appropriate control signal to the cartridge, or in the case of a color printing device, to multiple cartridges. Once the control signal is received, each cartridge will transfer ink through its print nozzles as the medium passes beneath. When the control signal is complete, the printing device will have generated a document or drawing on the medium.

Each use of the cartridge reduces the amount of toner or ink remaining in the cartridge. Depending on the size of the cartridge, a number of documents or drawings can be generated before the cartridge is empty or near empty. The larger the cartridge, the more ink it contains and the more documents can be printed. When empty, the cartridge needs to be replaced.

Cartridges can be expensive depending on many different variables, including the overall need for a particular cartridge, the popularity of the printing device (the more cartridges manufactured the less expensive the cartridge due to economies of scale), and the amount of competition for the cartridge manufacturer, among others.

Further, the cost of the ink or toner in a cartridge is relatively inexpensive and has very little effect on the cost of the replacement cartridge itself. Thus, as many printing device owners understand, merely replacing the ink or toner in a cartridge can be an extremely inexpensive alternative to replacing the entire cartridge.

A demand therefore exists for an automatic mechanism and method in which the customer can refill a printer cartridge that reduces or eliminates ink spillage, does not destroy the cartridge and is convenient and reliable. The present invention satisfies this demand.

SUMMARY OF THE INVENTION

The present invention is an automatic inkjet cartridge refilling system that is comprised of an arrangement of mechanical, electrical and electronic, pneumatic, and software elements that can be used by a customer to refill inkjet cartridges of various manufacture that are typically used in printing devices, such as printers connected to computers, facsimile machines and copiers.

The primary application of the invention is the placement of the refilling system in a retail location where a customer can present a used or empty inkjet cartridge for refilling. Having an empty or near-empty inkjet cartridge in-hand, a customer views the system's video display screen, which displays promotional information and pictorial/text descriptions of cartridges that can be refilled at the station. Upon matching one of the pictures with the cartridge in hand, the operator selects the area on the touch-activated display that represents the match. The display advances to a set of instructions that typically open a door and prompts the operator to insert the cartridge into the proper door on the front of the machine. In an alternate embodiment, the user is prompted to place the empty cartridge into a slot in a cradle. The machine detects the insertion of the cartridge and performs any necessary testing and if the cartridge is viable, performs an automated process of emptying, cleaning and refilling the cartridge. Upon completion of the refilling process, the machine tests the refilled cartridge and prompts the operator to remove the cartridge. Upon a satisfactory result, the refilled cartridge is returned to the customer and is ready for use. The customer is then charged for the service.

One aspect of the invention is a method of refilling a printer cartridge including providing an inkjet refilling station with a housing, a computer and software to control the refilling process, a plurality of cradles or doors in the housing, wherein each of the plurality of cradles or doors is sized and shaped to receive a predetermined printer cartridge. The station is configured such that once the cartridge is properly placed into the loading area of the station, a printer nozzle interface slides vertically into place making intimate contact with the cartridge print nozzles. Once in place, ink can be removed and refilled without needles, or the mess associated with refilling cartridges. The station also includes electronics, including an electronic controller for controlling operation of the station, pumps and hoses to transfer used ink from and new ink to the empty cartridge to be refilled, and an interface for the user to input information to the refilling machine. The printer cartridge is inserted into a corresponding one of the plurality of cradles or doors. The insertion of the printer cartridge is sensed. The printer cartridge is emptied, cleaned, and refilled and the cartridge is tested.

In a preferred embodiment of the method the steps of sensing, emptying, cleaning and refilling, and testing are done in a fully automated manner.

DESCRIPTION OF PREFERRED EMBODIMENTS

The present invention provides an automated and simple way to refill a printer cartridge without the mess or danger. The user merely enters information pertaining to the manufacturer's name and cartridge model into the system, properly places the cartridge into a slot or door, provides some form of payment, and the automatic refilling machine 10 does the rest.

Figure 1:
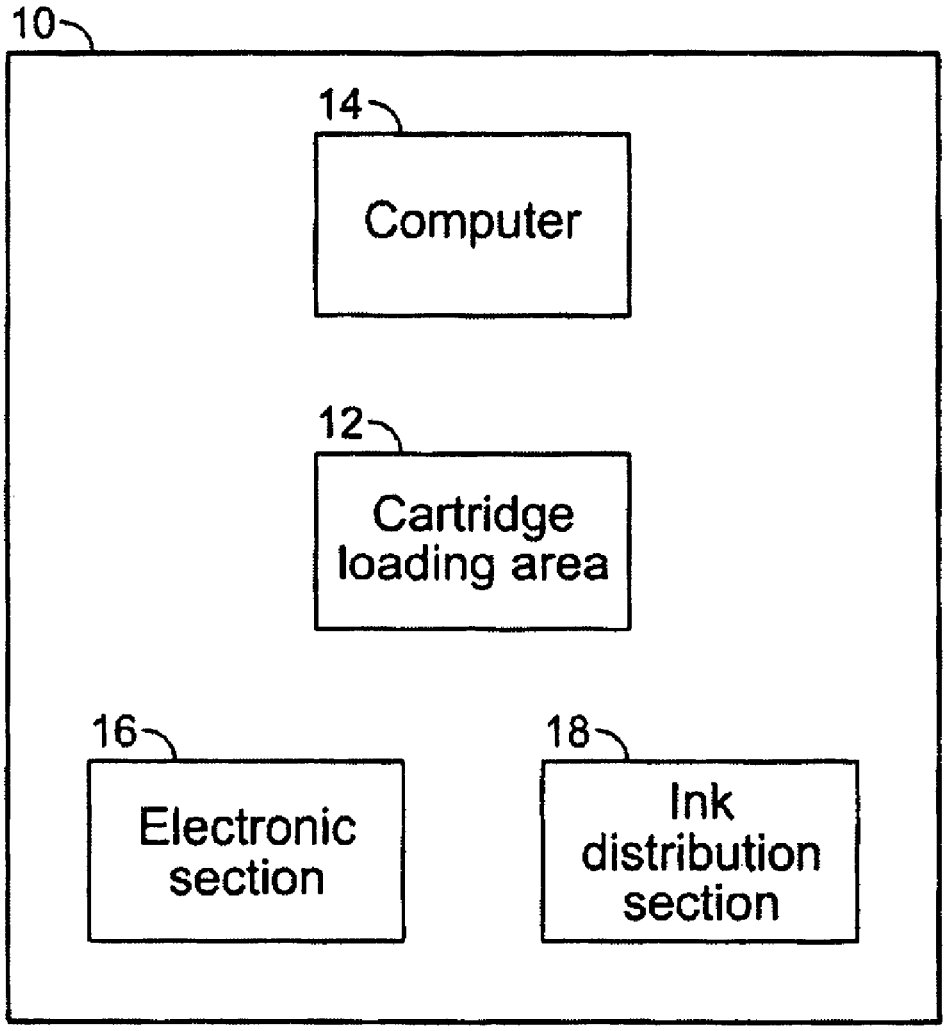
FIG. 1 is a functional block diagram of one embodiment of a cartridge refilling station according to the present invention.

FIG. 1 shows a functional block diagram of the automatic cartridge refilling station 10. The refilling station 10 consists of a cartridge loading area 12 where the empty or near empty cartridge is connected to the refilling station 10 for refilling, a computer 14, such as a personal computer or PC, which provides information to and obtains information from the customer and controls the operation of the refilling station 10. The refilling station also consists of an electronics section 16, an ink distribution section 18, which includes hoses or tubes to either dispose of the waste ink from the empty or near-empty cartridge or to provide refilling ink to the empty cartridge. The refilling station 10 also consists of the necessary wiring harnesses and other wiring to connect the various sections and components of the refilling station 10 to each other and to the electrical power.

Figure 2:
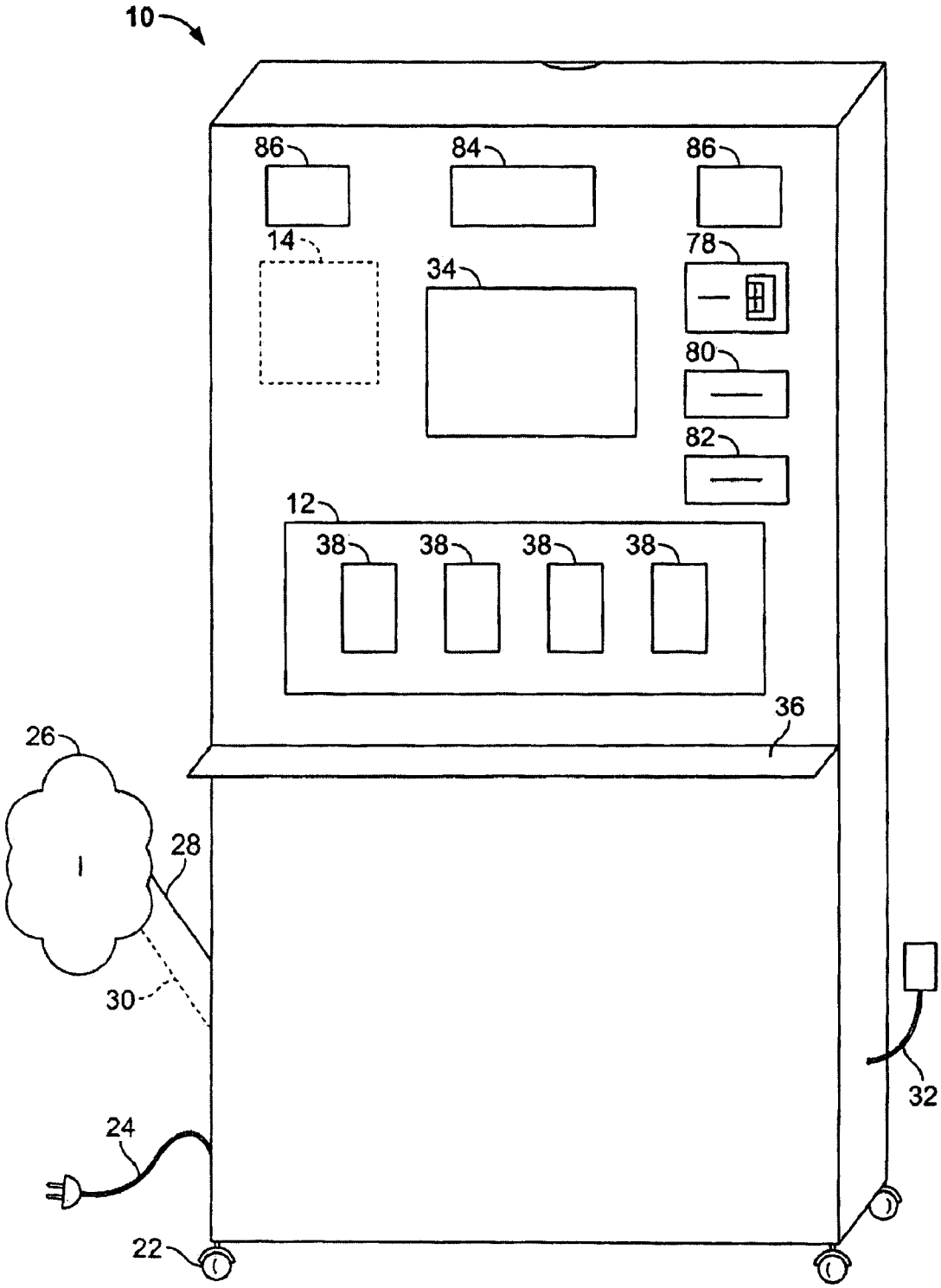
FIG. 2 is a front facing view of one embodiment of a cartridge refilling station according to the present invention.

In the preferred embodiment shown in FIG. 2, a cartridge refilling station 10 includes an upright housing or console 20 of preferably metal and wood construction having a footprint or base dimension of about 38"×28" and a height of about six feet, four inches. Rubber casters 22 are preferably attached to the base of the cartridge refilling station 10 so that it can be easily moved about. The refilling station 10 will need to be powered, usually through an AC power cord 24, and in the preferred embodiment, the refilling station 10 will be connected to the Internet 26, or an Intranet, either through a wired configuration 28 or through a wireless configuration 30. The refilling station 10 may also utilize a telephone connection 32.

Mounted within the front upper face of the refilling station 10 a display 34 is provided at a height that is convenient for the user to visually observe and manually manipulate. The display 34 is preferably a CRT or liquid crystal display with a touch-actuated input device or touch-screen display, which may or may not be integrated into the onboard computer 14, as described below. Of course, other input devices can be utilized, such as a keyboard, a trackball, a mouse, push-button switches, etc. (not shown) as understood by one having ordinary skill in the art.

The touch-screen display 34 serves the dual function of providing information to the customer, such as how to operate the refilling machine 10 and the status of the refilling procedure, while also allowing the user to enter information and interact with the refilling station 10 when necessary. The onboard computer 14 is programmed to provide the operation of the display 34 and control the components and operation of the refilling machine 10.

The cartridge loading area 12 is the location where the user loads the empty or near empty cartridge onto the refilling station 10 prior to refilling. The cartridge loading area is also located on the front of the refilling station 10 in a setting that is convenient for the customer. A shelf 36 can be provided for the customer's convenience to place the cartridge before loading or to place other items such as a purse or wallet.

In the preferred embodiment, the cartridge loading area 12 consists of multiple door assemblies 38 at the front of the cartridge refilling station 10. Each door assembly is spring loaded so that once the proper door is established, a signal is sent and the door opens. The customer then inserts an empty cartridge into the tray or slot in the door assembly 38, and pushes the door closed, which based on the configuration of the door assembly, properly locates the empty cartridge. The cartridge is then ready to be accessed and refilled.

Figure 3:
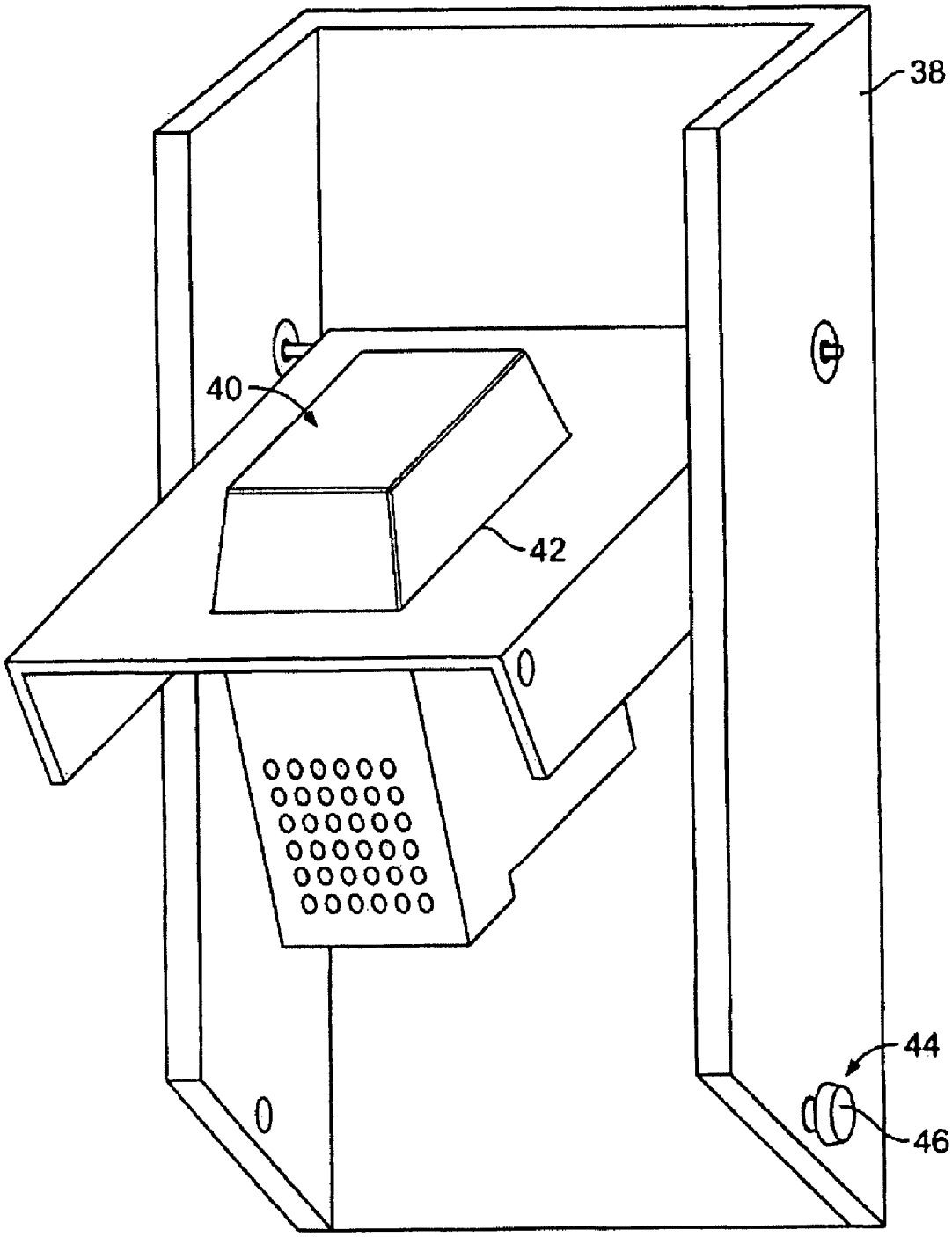
FIG. 3 is an illustration of one embodiment of a door assembly with cartridge according to the present invention.
Figure 4:
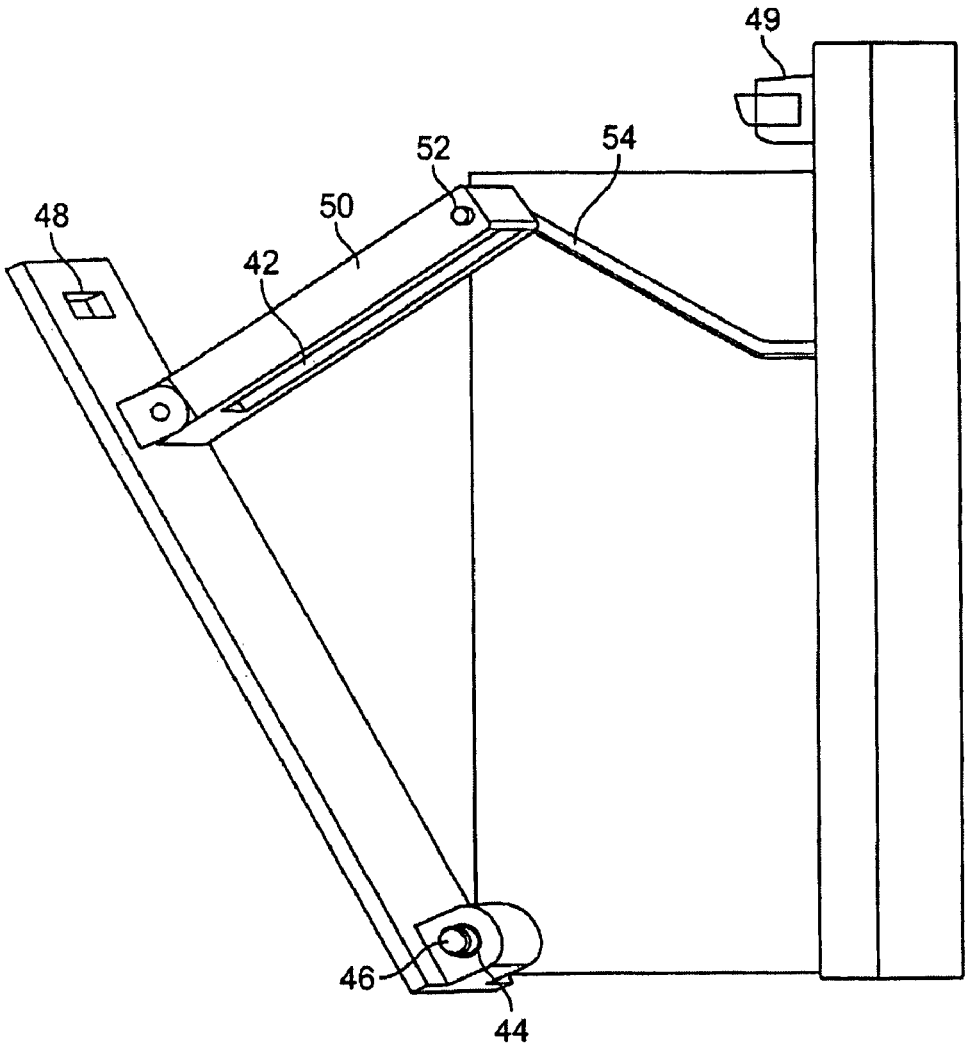
FIG. 4 is a side view of one embodiment of a door assembly without a cartridge according to the present invention.
Figure 5D:
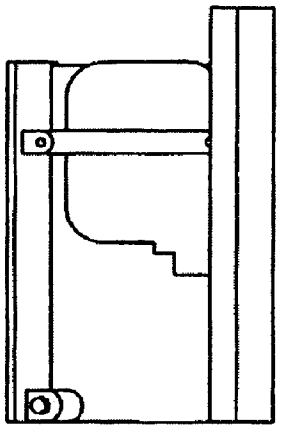
FIG. 5*a*-5*d* is a side view of one embodiment of a door assembly with cartridge as it moves from open to closed according to the present invention.
Figure 5C:
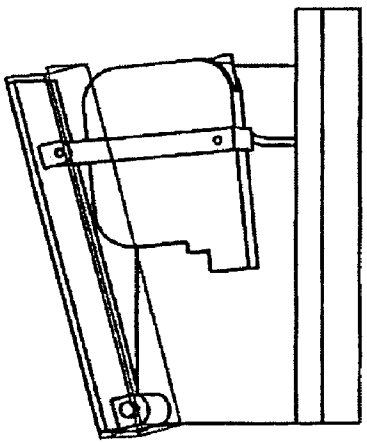
Figure 5B:
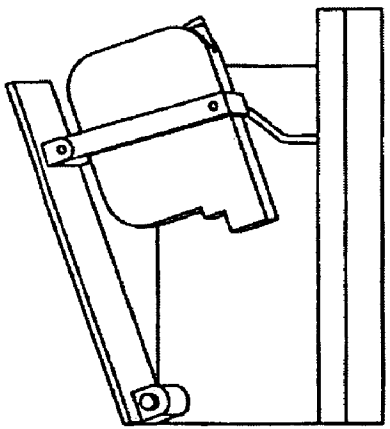
Figure 5A:
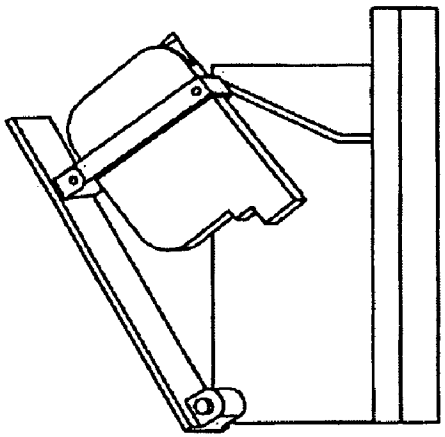

FIG. 3 shows a door assembly 38 for the cartridge loading area 12 with a cartridge 40 already inserted into the slot 42 for refilling. The door assembly utilizes springs 44 at the bottom pin 46 in order to put pressure on the door assembly 38 to swing open at the hinged end, preferably at the bottom of the door. FIG. 4 shows a side view of an empty door assembly 38. The slot 42, which will vary in size, will accept certain sized cartridges, while the pin 46 and the springs 44 connect the door assembly to the cartridge loading area 12 of the refilling station 10.

The door is kept shut using a solenoid and magnet assembly 48 such that when the door is closed, the magnet attracts and keeps the door closed. When the door is to be opened, the solenoid is charged and the magnet is retracted away from the door. Once the magnet is removed, the spring 44 forces the door assembly 38 open. A viscous lubricant or some other damper (not shown) is used to prohibit the door assembly from opening up too quickly.

As described above, multiple door assemblies 38 are used in the cartridge refilling station 10 for the many different types and sizes of cartridges. Although there are numerous ink cartridges, many have a similar size and configuration so that one door assembly 38 may be used on a number of different cartridges, thus reducing the number of door assemblies needed. Also, many cartridge manufacturers use different designs and different configurations than their competitors, especially the configuration at the top of each cartridge. As such, one manufacturer's cartridge may not fit into the competitor's printer. The present invention works without the need to access the top of the cartridge and thus cartridges with similar configurations but differently designed tops can still be placed into the same door assembly.

In the preferred embodiment, each door assembly will allow for the refilling of cartridges of a similar size and configuration. For example, four door assemblies may be used for filling a great majority of the different cartridges in existence. Obviously, more (or less) doors can be utilized.

Each door assembly 38 contains a tray 50 in which the slot 42 is located. Each tray 50 contains a pin 52 (shown on the facing side of the tray 50 in FIG. 4) for directing the tray 50 into the proper location when the door assembly 38 is closed. The door assembly 38 also contains a locating groove 54 that, based on the pin 52 running inside the groove 54, locates the tray 50 and thus the empty cartridge into the proper position to make contact for refilling.

FIGS. 5*a* through 5*d* show the door assembly 38 in operation. Once an empty cartridge 40 is placed in the slot or opening 42 in the tray 50, the door assembly 38 is ready to be closed. As the door assembly 38 is closed (5*a*), the pin 52 (shown on the opposite side of the tray 50), which is located in the locating groove 54, forces the leading end of the tray 50 downward as it hinges from the door itself. As the door assembly is closed further (5*b* and 5*c*), the tray 50 and thus the cartridge 40 are further forced downward and placed into position to make contact with the wall. Finally, as the door assembly is closed completely (5*d*), the cartridge comes to rest in the correct position for accessing the electrical contacts and print nozzles for refilling.

Figure 6:
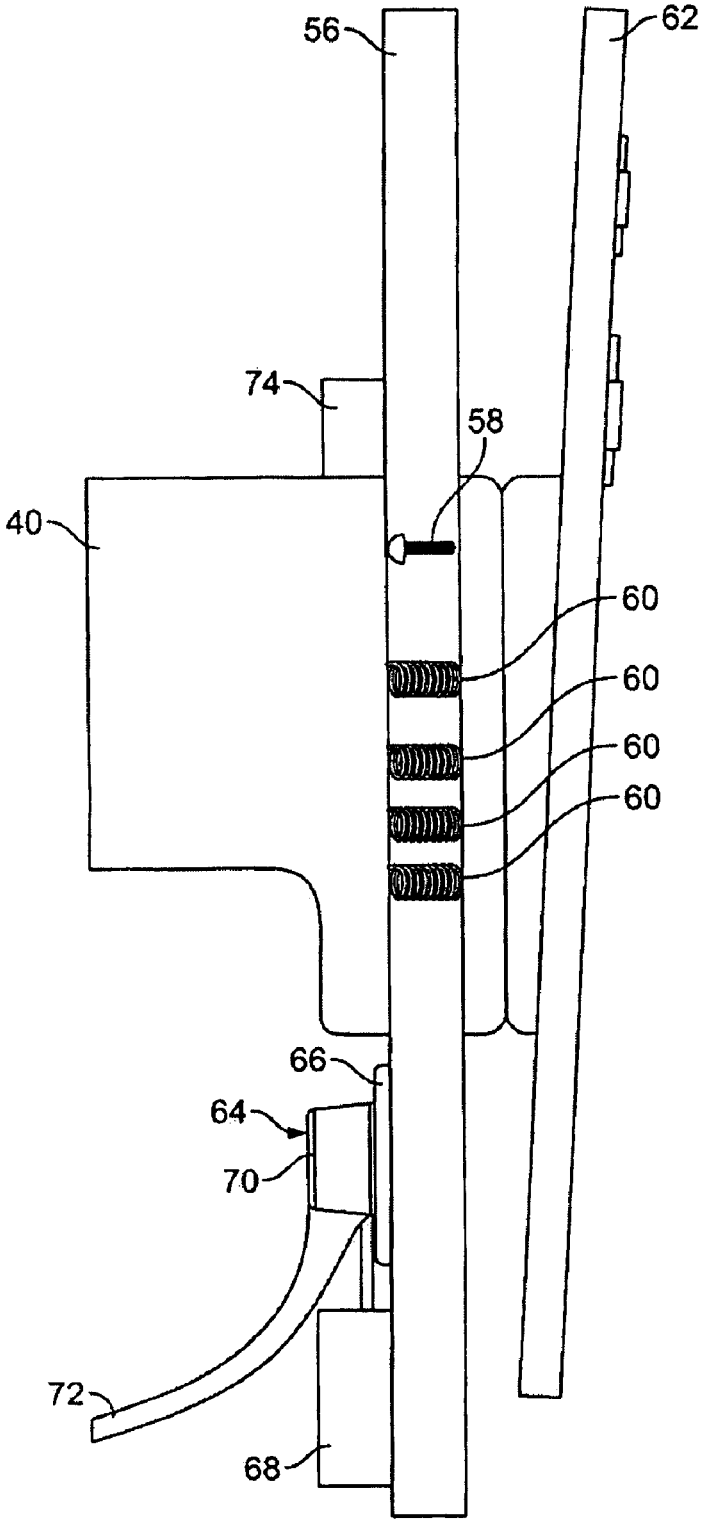
FIG. 6 is a cutaway side view of one embodiment of the cartridge loading area according to the present invention.

Once the cartridge is properly located, both the contacts and the print nozzles on the empty cartridge can be accessed during the refilling procedure. As an example, the Lexmark 75 black ink cartridge has approximately 540 nozzles and 28 contacts and proper alignment both for the nozzles and the contacts is necessary for proper refilling. FIG. 6 shows a side cutaway view of the refilling station 10 at the location where the empty cartridge 40 comes to a rest after the door assembly 38 is closed. The wall 56 where the cartridge comes to rest is made up of an insulator material, such as Delrin, and allows for pins and other electrical components to be placed near the cartridge without creating short circuits. A cartridge present switch 58 is located in the wall such that when a cartridge 40 is present, the switch 58 will be depressed and the refilling station computer 14 will know that a cartridge 40 is present. Further, spring loaded contact pins 60 are located at the insulated wall 56, such that when the cartridge 40 is present, the pins 60 make contact with the contacts located on the cartridge (not shown). Once contact is made, a signal can be sent from or to the cartridge module printed circuit board 62 for driving, detecting, testing and communicating with the cartridge 40.

The printer nozzles (not shown) must also be properly accessed so that the empty cartridge 40 can be refilled with ink. In order to contact the printer nozzles for refilling, once the door is closed and the cartridge is in its proper place, a printer nozzle interface 64, which is arranged in a pair of guides 66, slides vertically up and down by a stepper motor 68 (or the like) to make intimate contact with the cartridge print nozzles. The print nozzle interface is made up of a machined plastic block 70 with an integrated hose 72 that is connected to the ink distribution system for removing and discarding ink or refilling the cartridge with new ink. When the printer nozzle interface 64 is moved into place by the motor 68, a pressure-tight seal is created which allows for the transfer of ink out of and into the cartridge. A stop 74 is located at the top where the door closes in order to keep downward pressure on the cartridge during the refilling process.

Figure 7:
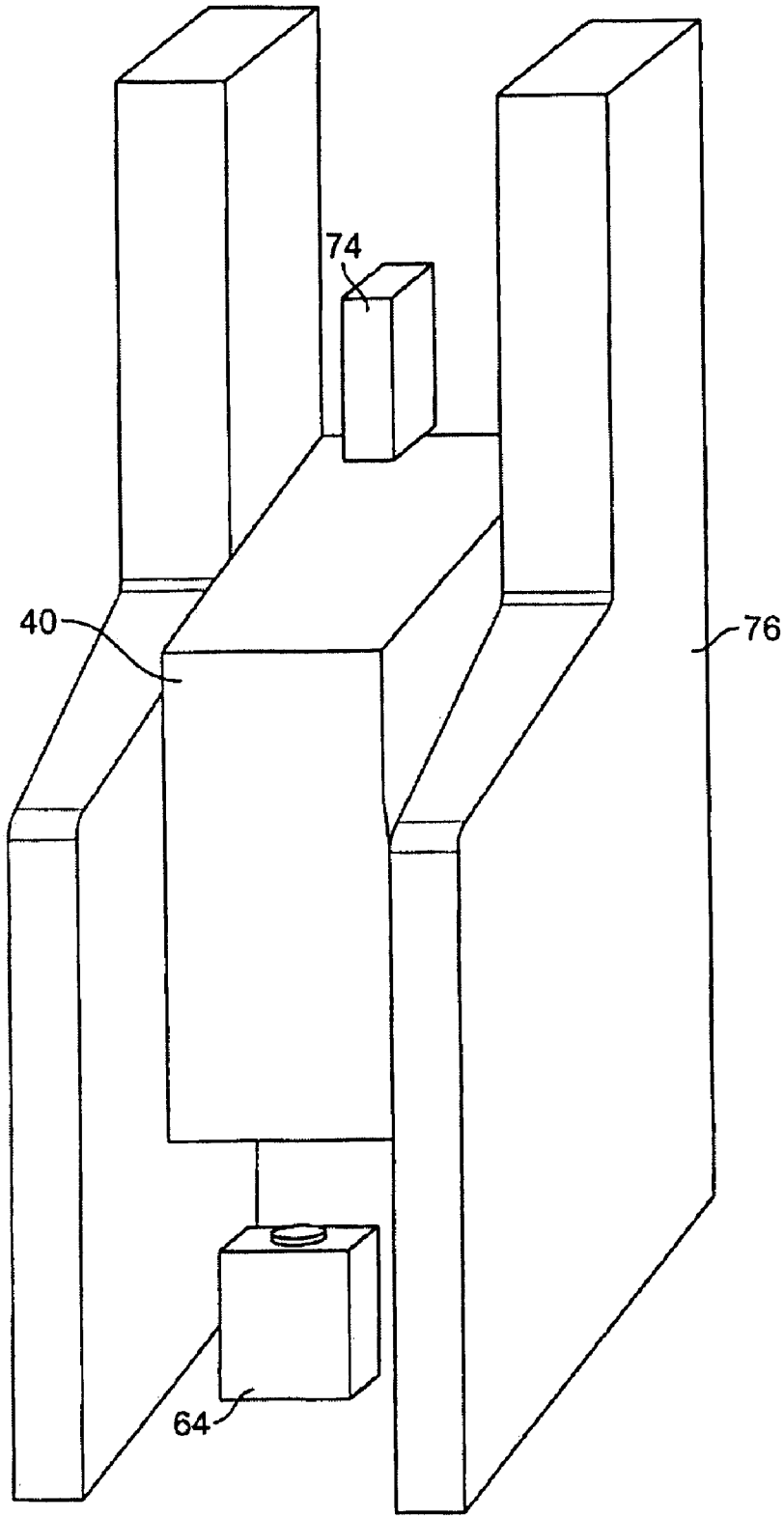
FIG. 7 is an illustration of an alternative embodiment of the cartridge loading area according to the present invention.

With this configuration the chance of an improper connection is reduced. FIG. 7 shows an alternative embodiment to the door assembly 38. Instead of a door automatically opening to allow the customer to place the empty cartridge in, the customer can be prompted to insert an empty cartridge into a receiving block 76 such that proper connections are made between the printer nozzles and the electrical contacts. The receiving block 76 can be configured such that the cartridge 40 will snap and lock into the proper position against the contacts and the printer nozzles.

Instead of the customer inserting the cartridge 40 against the contacts and printer nozzles, the receiving block 76 may be configured to utilize a printer nozzle interface 64 that is moved into place after the customer inserts the cartridge 40. In that event, a stop 74 may be used to keep downward pressure on the cartridge 40 as the printer nozzle interface 64 is moved into place as described above.

Once the empty cartridge is properly located in the cartridge refilling station 10 a computer program located in the computer 14 prompts the user to enter the proper information about the empty cartridge 40 in order to begin the refill process. As described above, the preferred embodiment for prompting the user is to use a computer with an algorithm that allows the user to enter the information through the touch-screen display 34, although various input/output (I/O) devices can be used to enter the information. The display 34 allows the user to input information including the type of cartridge to be refilled and information about the user such as name and address.

In the preferred embodiment, the touch-screen display 34, located at the front of the cartridge refilling station 10, is used to provide the user with instructions in order to refill the cartridge. The display 34 can also provide information to the user while the cartridge is being refilled, such as how many more times the cartridge can be refilled before it must be replaced, and other various error messages. Further, the monitor can provide advertisements to the user as described below, depending on the user, the type of cartridge and various other factors.

The cartridge refilling station 10 also contains a credit card reader 78 located at the front of the station 10 and shown in FIG. 2. The credit card reader 78 allows the user to make payment for refilling the cartridge. The refilling station 10 is connected to and communicates with a remote computer (not shown), either through its telephone line or Internet connection, so that the credit card information can be verified as understood by one having ordinary skill in the art. The refilling station 10 may also contain a drawer 80 for accepting cash from the user and dispensing change accordingly. Because the refilling station 10 is connected to a remote computer, modifying the refilling pricing is easily accomplished.

The cartridge refilling station 10 also contains a printer 82, which is capable of printing a credit card or cash receipt for the purchase of the ink. Further, if the user decides to purchase other items, for example, based on the advertisements, a receipt can also be printed for that particular purchase.

The cartridge refilling station 10 may also contain a detector 84, such as an infra-red or motion detector, to detect when a user or potential user approaches the cartridge refilling station 10. Once detected, the user can be told about the various functions of the cartridge refilling station 10 or can be shown other advertising. The cartridge refilling station 10 also contains a speaker or multiple speakers 86 for audibly instructing the user (for example how much time is left to refill the cartridge), playing music to pass the time, advertising the cartridge refilling station 10 functions or other products or services, or any combination of these functions.

The computer 14 controls the overall operation of the cartridge refilling station 10. The computer 14 consists of a microprocessor, memory (usually Random Access Memory or RAM and Read-Only Memory or ROM), and various I/O devices such as the touch-screen display 34, a CD ROM or DVD reader, a keyboard, and mouse (not shown). As with most computer systems, the microprocessor, memory and the various I/O devices are integrated into the computer 14. Various programs can be loaded into the memory of the computer 14 to provide control of the system, video display for the user, prompting the entry of information, etc.

In the preferred embodiment, the computer 14 is the Global American model 2907257. However, many different computers can be used to control the overall operation of the cartridge refilling station 10 as understood by one having ordinary skill in the art.

Another important aspect of the computer 14 is its communication system. In the preferred embodiment the computer 14 will be connected through cabling 28 or wirelessly 30 to the Internet 26 or to an Intranet as understood by one having ordinary skill in the art. Once connected, or on-line, many more functions of the cartridge refilling station 10 are capable. At the outset, the programs to run the cartridge refilling station 10 can be downloaded into memory. However, access to the Internet may be necessary to upgrade the programs running the refilling station 10 at a later date. Further, if during use information about a particular empty cartridge is not in the computer memory or database, the cartridge refilling station 10 can go search for the information about that particular cartridge on-line. Also as described above, the cartridge refilling station may display advertisements to the user while the cartridge is being refilled.

Instead of installing the advertisements using the CD-ROM reader or storing into the computer memory, the refilling station 10 can download the video over the Internet 26. Further, once the information about the user is known, the cartridge refilling station 10 may access different advertisements for that particular user. The decision about which advertisements will be displayed may occur off-site at a remote location and the video will be streamed or downloaded over the Internet 26.

In the preferred embodiment, the cartridge refilling station 10 will be also connected through an Intranet for security and privacy reasons as understood by one having ordinary skill in the art. Further, using the Internet or an Intranet the cartridge refilling station 10 can communicate about its various conditions. For example, if the bottle of blue ink is running low and needs to be replaced, the cartridge refilling station 10 can transmit that information either to an individual in the same location as the cartridge refilling station 10, or to a remote location, so that some action can be taken, i.e., refill the blue ink bottle. The same communication may be necessary when the ink discard bottle becomes full.

Figure 8:
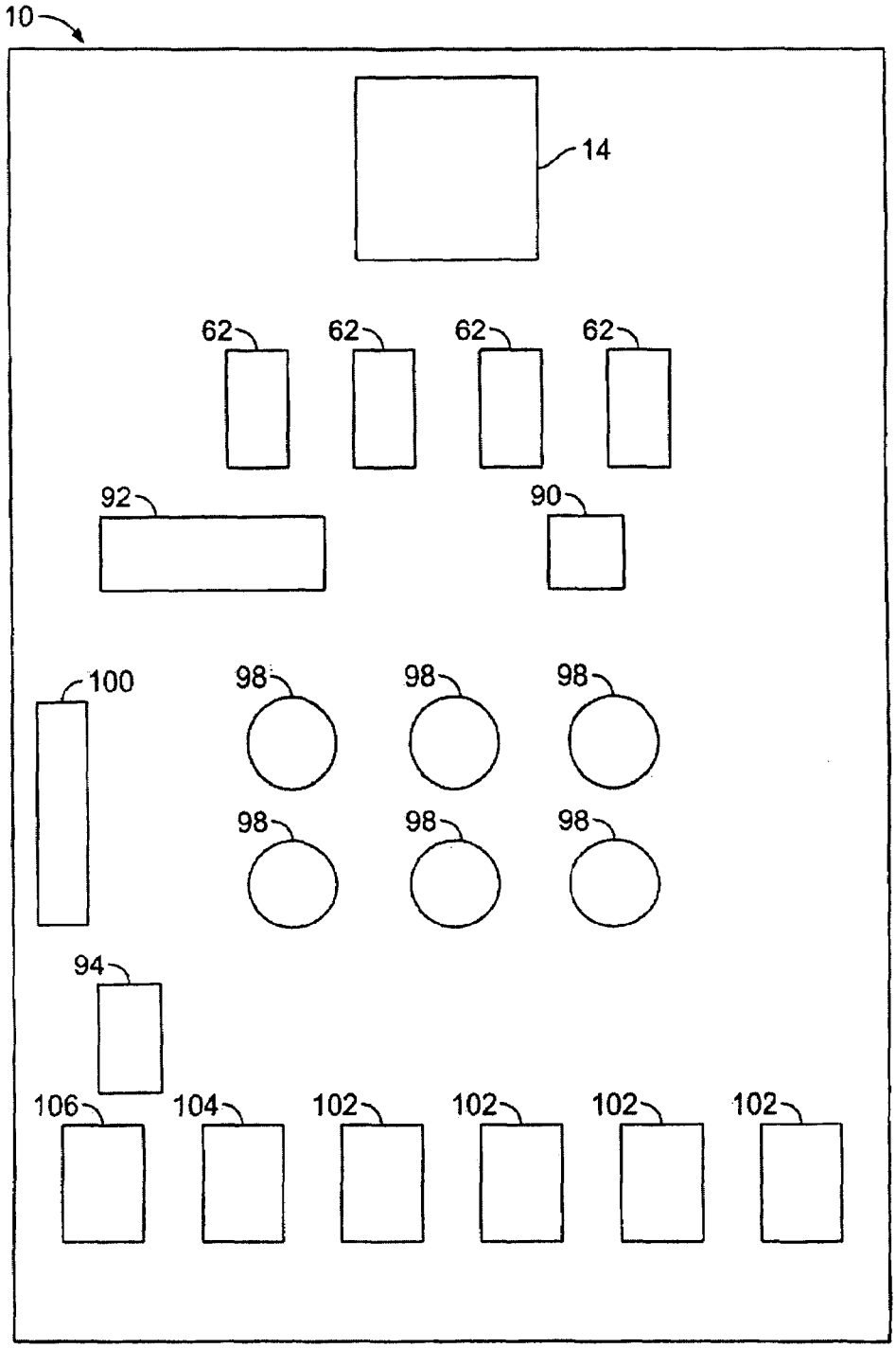
FIG. 8 is a rear view of one embodiment of a cartridge refilling station according to the present invention.

FIG. 8 shows the backside of the refilling station 10. In order to accomplish the refilling procedure, the refilling station 10 uses the computer 14, the electronics section 16 and the ink distribution section 18. The electronics section 16 and the ink distribution section 18 consist of a programmable logic controller or PLC 88, such as the Mitsubishi FX-2N, an analog module 90, cartridge module printed circuit boards 62, a vacuum selector 92, pressure sensors 94, vacuum sensor 96, vacuum pumps 98, such as the Barnant model 16.8 ml peristaltic vacuum pump, a vacuum reservoir 100, ink supplies 102, cleaning fluid 104, waste supply 106, and the ink detector pc boards (not shown). Further, the refilling system includes wiring harnesses (not shown) to connect the various components to each other and to electrical power, and hoses or tubes (not shown) to transfer the ink from and to the cartridge 40.

The computer 14 controls the overall operation, however, the PLC 88 controls the vacuum selector and ink waste selector for each of the colors, cyan, magenta 2 and yellow, and for black. Further, the outputs from the pressure sensors 94 are transmitted to the PLC 88. Also, the vacuum sensor 96 can be used to sense a vacuum as described below, and based on an understanding of the particular cartridge can provide a virtual measurement of the cartridge.

The peristaltic vacuum pumps 98 and tubing is used to transport the new and used ink from and to the containers. Six pumps 98 are used in the preferred embodiment to refill the empty ink cartridges. One pump 98 is used for each of the colors, black, cyan, magenta and yellow, and separate pumps are used for the cleaning fluid and for the waste. The pumps are connected from each bottle corresponding to the colored ink and the waste and cleaning fluid through a vacuum selector 92 which can connect the vacuum pump 98 (for filling, emptying or cleaning) to each of the stations. So for example, if it is determined that a yellow ink cartridge has been placed in refilling area 2, the vacuum selector 92 will first select the pump 98 for discarding waste from the cartridge in that area. The remaining ink will then be removed from the cartridge and transferred to the waste receptacle 108. Then, the yellow ink container 102 will be selected and yellow ink will be pumped into the empty cartridge 40. Once full, the pumps 98 will be turned off and the user will be notified that the cartridge can be removed.

Further, various sensors are used during the refilling operation to obtain information about the ink distribution system 18, etc. Each ink supply contains a pressure sensor 94 and a vacuum sensor 96 for sensing when a vacuum is or is not present in the lines. Also, a vacuum selector 92 is used to connect the vacuum to the various lines when needed as described below.

Accordingly the cartridge refilling station 10 enables a consumer or user with minimal or no training to easily install an empty or near empty inkjet cartridge, such as those used in printers, copiers and facsimile machines, onto the fully automatic cartridge refilling machine or station 10 for refilling the empty cartridge. The user is then able to operate the station 10 to refill the empty cartridge by reading, viewing and following the instructions as they appear on a touch-screen display 34, which is integrated into the refilling station 10, and then responding accordingly.

Figure 9A:
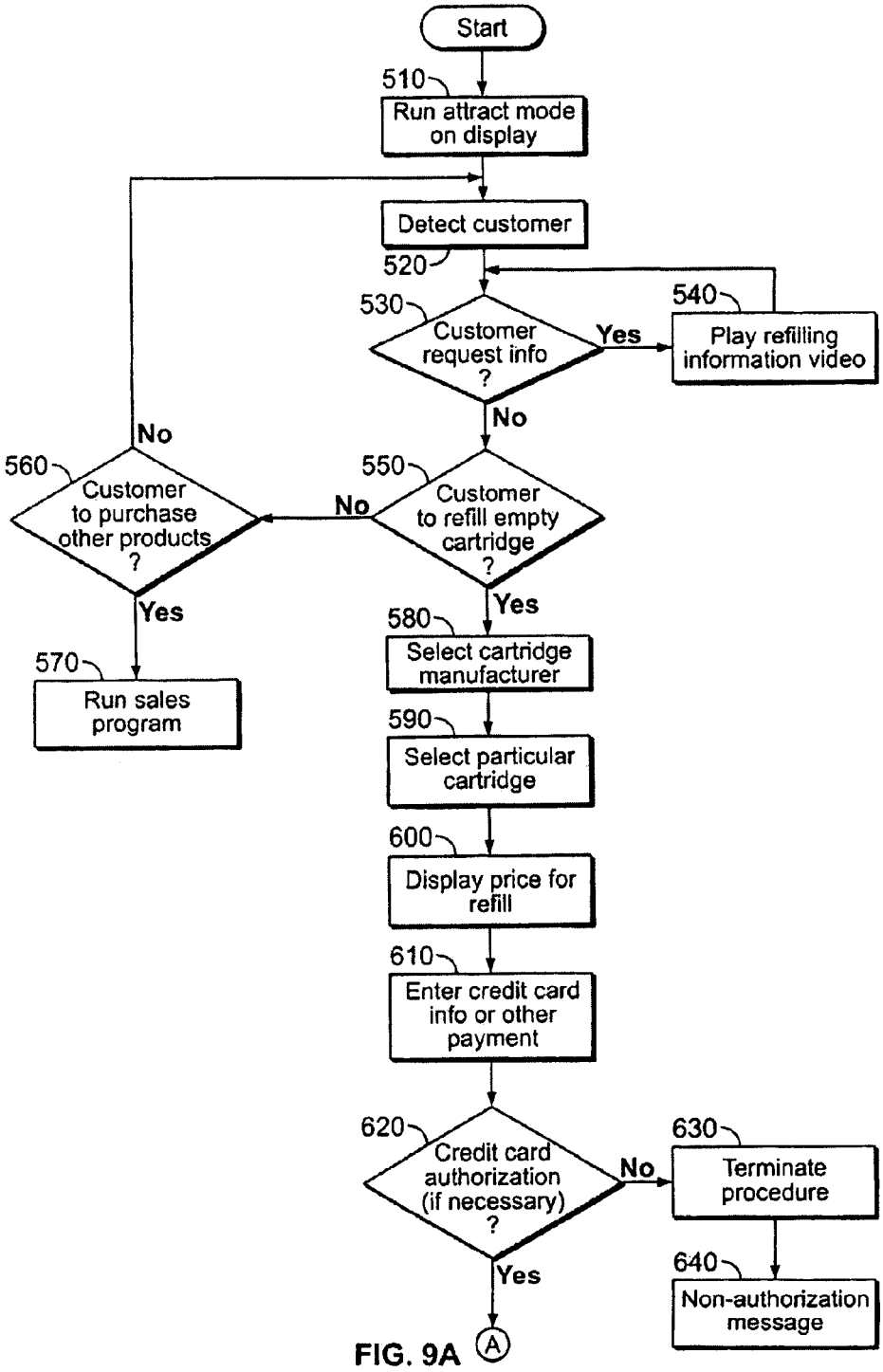
FIG. 9*a*-9*c* is a flow chart of the operation of one embodiment of an inkjet refilling station according to the present invention.
Figure 9B:
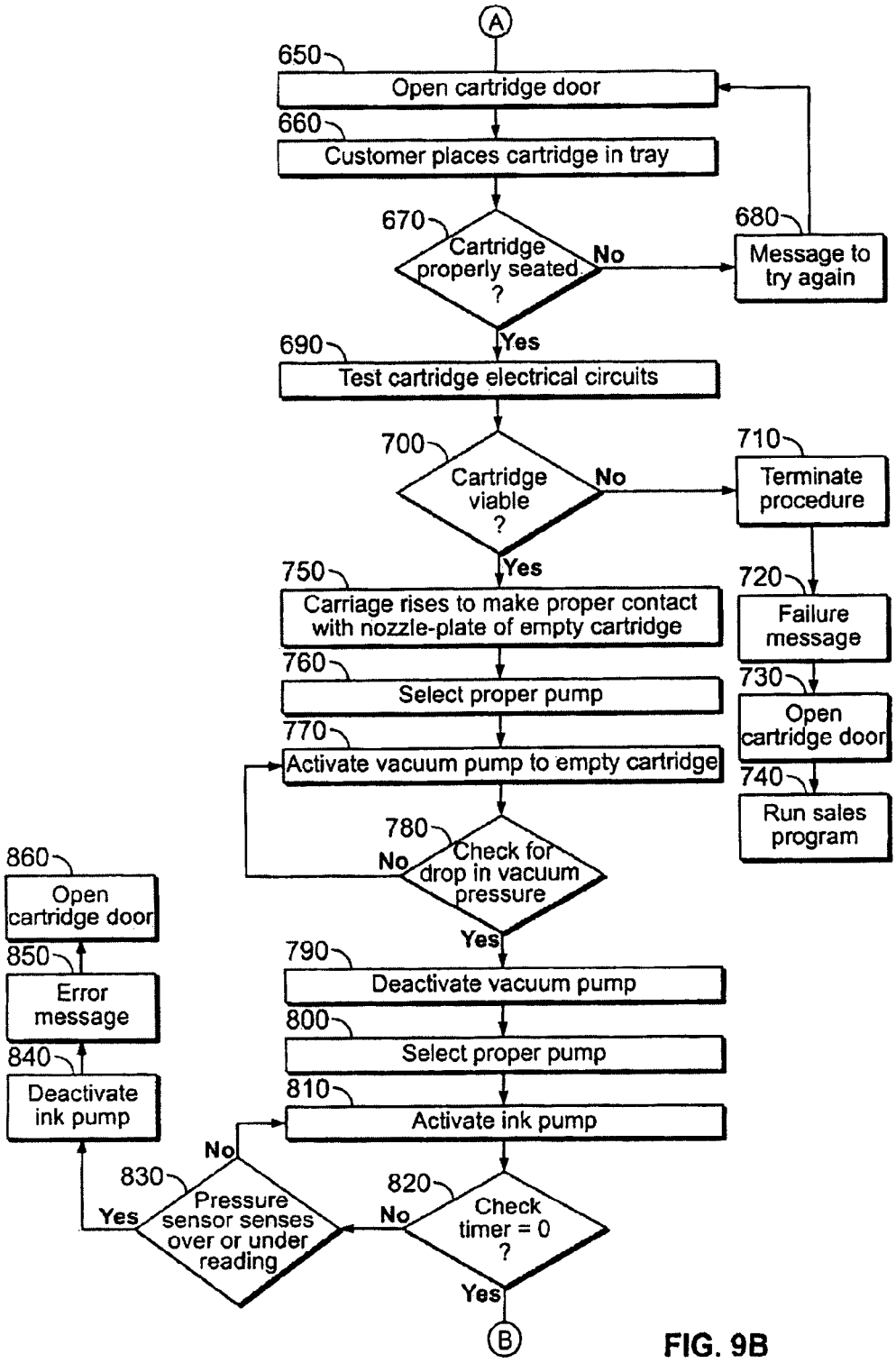
Figure 9C:
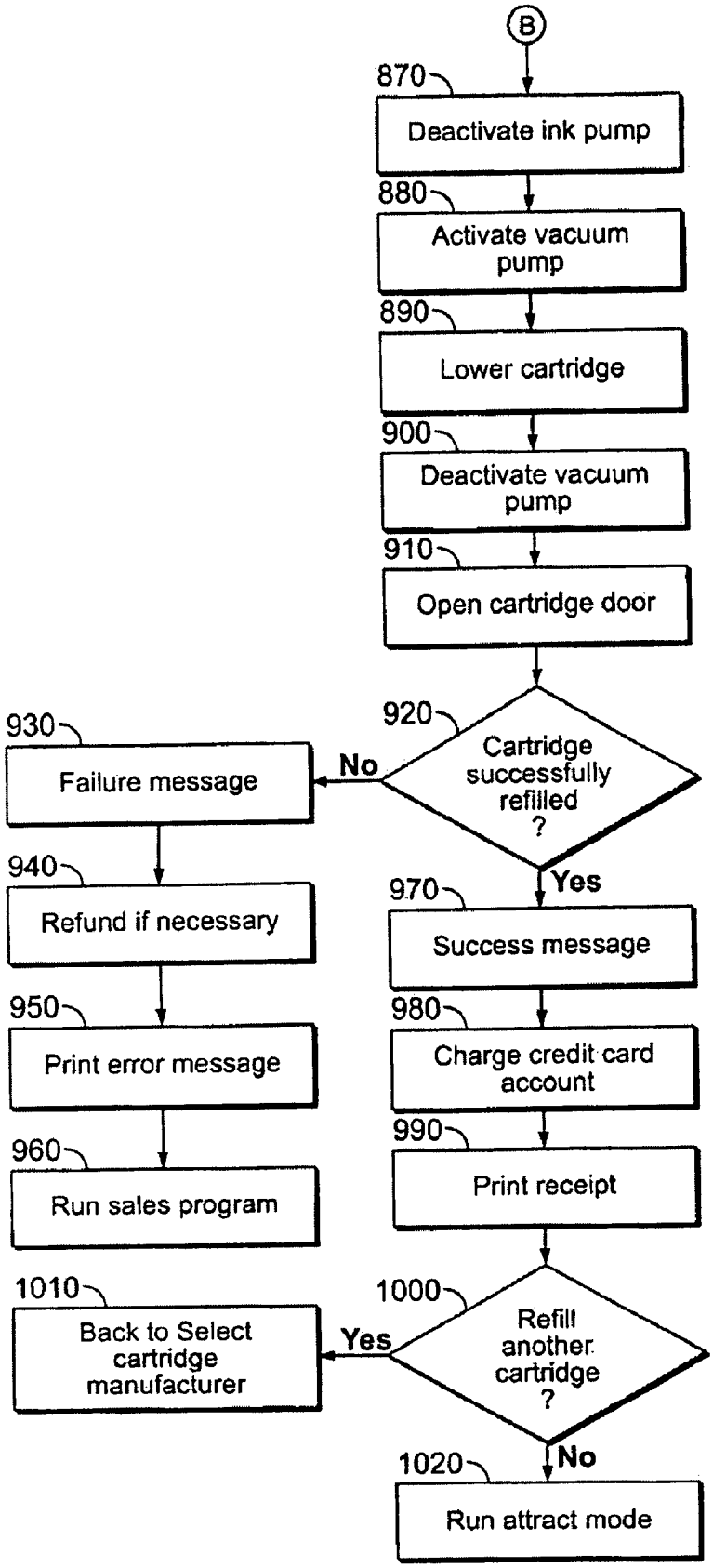

FIGS. 9*a*-9*c* show a flow chart for the preferred method of operation of the inkjet cartridge refilling station 10. As described above and with references to the previous figures, the refilling station 10 contains an infrared motion sensor 84 that senses a customer approaching. The sensor 84 is connected to a PLC 88 that is in turn connected to a computer 14, which contains a touch-screen input and display 34 among other features. These devices are connected and programmed such that when the system does not detect a customer, it will run a video presentation program on its screen to attract potential customers or to advertise its services or other products or services. This is shown as box 510 in FIG. 9.

However, the action of a person approaching the unit 520 causes the main computer to run a video presentation program located in the main computer wherein either a live-action, animated, or computer-generated actor invites the approaching "customer" to refill an inkjet cartridge. The program can also be located remotely and accessed via a network, such as the Internet 26, through either a wired 28 or wireless 30 connections.

The customer can be presented with various displays and choices, such as receiving more information 530, proceeding with the refill operation 550, or just viewing advertisements for the refilling machine or for other products and services 560. These choices are presented as areas on the screen 34 that are touch-sensitive, and so enable the PC's program to be directed by action of the customer. If the customer touches a "more information" button, a presentation explaining the operation of the machine for refilling inkjet cartridges is displayed on the screen 540. If the customer chooses to proceed with the refilling of an inkjet cartridge, it is assumed that the customer has an empty inkjet cartridge ready for refilling, and the business logos corresponding to the several inkjet cartridge manufacturers are displayed on the screen. The customer is asked to touch the area of the screen displaying the manufacturer's logo for the cartridge that the customer wishes to refill 580.

Since each manufacturer has multiple cartridges, the customer must select the exact inkjet cartridge to be refilled. The program retrieves a list of cartridges produced by the selected manufacturer from its memory (or over the Internet). This list is presented as a set of touch-zones on the display 34 and the customer is asked to select the one that matches the cartridge to be refilled 590.

Upon selection, the computer 14 displays on its screen 34 the price for the refilling service 600. The customer is asked to insert a credit card into a credit card reader 78 on the face of the machine as a form of payment 610. Of course, the refilling machine 10 can be configured to accept cash through a slot 80, debit cards or other forms of payment 610. The reader reads and sends the credit card information to the computer 14. The computer 14 through a connection to a telephone line 32 executes the protocols required to dial a payment processor and verify that the card is acceptable as a form of payment 620. The actual debit is delayed pending successful completion of the refilling service. If the card is not validated the session is terminated 630 and a non-authorization message is displayed 640.

If the card is valid, the computer 14 through its connection to the PLC 88 and to a door latch mechanism 48 causes a door assembly 38 on the front of the refilling station 10 to open 650. The door assembly being horizontally hinged 44 at its bottom opens by action of its top rotating toward the customer. A tray 50 having an opening 42 that conforms to the girth of the cartridge 40 is attached to the inside of the door assembly 38 and by its mechanical arrangement travels with the door as it opens. The opening 42 in the tray 50 being exposed, the computer 14 displays a demonstration video that instructs the customer how to insert the cartridge 40 into the opening 42 and push the door assembly 38 closed 660.

By the action of closing the door assembly 38, the cartridge 40 is guided using a guide pin 52 and track 54 and locates firmly into precise position. When the empty cartridge 40 moves into the proper position, the electrical contacts feature of the cartridge is forced into mating with an array of spring-loaded electrical contact pins 60. These pins 60 are connected to an arrangement of electronic circuitry 62 that by its connections and program is capable of manipulating the cartridge's internal circuitry. As it moves into proper position the cartridge 40 also depresses and activates a sensor switch 58 that is connected to an arrangement of electronic circuitry that in turn signals the computer 14 that the insertion has occurred. The refilling system 10 tests if the cartridge is properly seated 670 and requests the user to try again if it is not properly seated 680.

On receipt of the signal, the computer 14 executes a sequence of commands to the cartridge electronics to run a program that tests the electrical circuits of the cartridge 690. If the test result indicates that the cartridge is not electrically viable 700, the session is terminated 710, an error message is displayed 720, the cartridge door assembly 38 is opened so the cartridge can be removed 730, and a sales program can be performed 740 to allow the user to purchase another cartridge 740.

Alternatively, if the cartridge 40 is electrically viable, the computer 14 issues a command to the PLC 88 and peripheral-equipment connections begin the sequence of operations necessary to refill the cartridge.

Below the cartridge 88, a printer nozzle interface 64, which consists of a machined plastic block mounted in a pair of guides 66 arranged that it may slide on its vertical axis in and out of a position abutting the nozzle-plate feature of the cartridge 750. The block 64 is constructed such that its upper surface comprises a compliant "mouth" that by its rising motion, the block 64 is driven into intimate contact such that a pressure-tight seal is accomplished with the nozzle-plate feature of the cartridge. The mouth enclosing a connection for the free flow of liquid or air between it and a hose-port 72 upon the back face of the block 64 is in turn connected to a selector valve.

The valve is electrically connected to and controlled by the PLC 88 to select between vacuum or ink sources at the nozzle plate of the cartridge 40. The block 64 being mechanically affixed at its lower surface to a linear-acting stepper motor 68 that is in turn connected electrically to the PLC 88 enables the PLC 88 by its program to drive the mouth into contact with the nozzle-plate component of the inkjet cartridge.

The PLC 88 through its connections to an electrically operated vacuum distribution valve and a peristaltic vacuum pump 98, selectively powers a pump/valve arrangement such that a vacuum is presented at the cartridge nozzle plate 770. As a result, unused ink that remained in the cartridge flows out of the cartridge through its nozzle plate, the mouth, carriage block, connecting hose, selector valve (which is in the "vacuum-selected" position), through the pump and into a waste container 106. The operation continues until the PLC 88, through its electrical connection to a vacuum sensor connected in the vacuum line detects a drop in vacuum 780 indicating the cartridge is empty, terminates it 790.

The PLC 88 through its connections to the vacuum/ink valve and a peristaltic ink pump 98 selectively 800 powers a pump/valve arrangement 810 such that ink is drawn from a supply reservoir or bottle 102 through the hose, the peristaltic pump, the selector valve, the carriage block, the mouth, and into the cartridge. This operation persists for a period of time 820 that corresponds to the amount of ink that the subject cartridge can hold and the delivery-rate specification of the pump. When the period of time 820 ends, the system 10 deactivates the pump 870.

The fill-time is programmed into the computer 14 and loaded into the PLC 88 by its connection to the computer 14 at system power-up. The PLC through its electrical connection to a pressure sensor that is connected in the ink-supply path is able to monitor ink supply pressure. In the event that "over" or "under" reading of ink-supply pressure 830 is detected by the PLC 88, the operation is terminated 840, an error message 850 is sent to the user and the cartridge door is opened 860. At this time, the sales program 740 can also be displayed.

Upon termination of the fill process the PLC 88 by its program and through its connections selectively powers a pump/valve arrangement 880 such that a vacuum is presented at the nozzle/mouth interface. Concurrently the PLC 88 causes the carriage to retract slowly away from the cartridge 890 thus severing the intimate contact between the mouth and nozzle plate and drawing any latent ink into the mouth and ultimately into the waste-ink container 106. The pump 98 is then deactivated 900. Retraction continues for a predetermined time such that the mouth is surely clear of the nozzle plate.

The program transmits a signal to release the door assembly 38 thus revealing the cartridge 910. The PLC 88 communicates to the computer 14 that the refilling procedure is complete and whether it was completed successfully or not 920. The PC displays a video that informs the customer of the success 970 or failure 930 of the refilling procedure. If the system 10 failed to refill the cartridge, a refund is made if necessary 940 and the error message is displayed and printed 950. At this time, the computer 14 can run a sales program 960. If the system successfully refills the cartridge, it instructs the customer to remove the cartridge and close the door, inquires whether the customer would like to refill another cartridge 1000, and presents "yes" and "no" touch-activated buttons for the customer to touch in response. In the case of a "yes" answer the process described is repeated 1010. Alternatively an accounting is made by the computer 14 in its program of the total dollar amount for the refilling services provided. The computer 14 resumes its connection to the payment processor and debits the credit card account previously presented 980. The system then prints a receipt 990.

Having completed the service transaction, and if no more refilling is requested, the PC returns to the attract mode 1020, and is re-armed to detect the approach of a potential customer by its infrared motion sensor 84.

Figure 10:
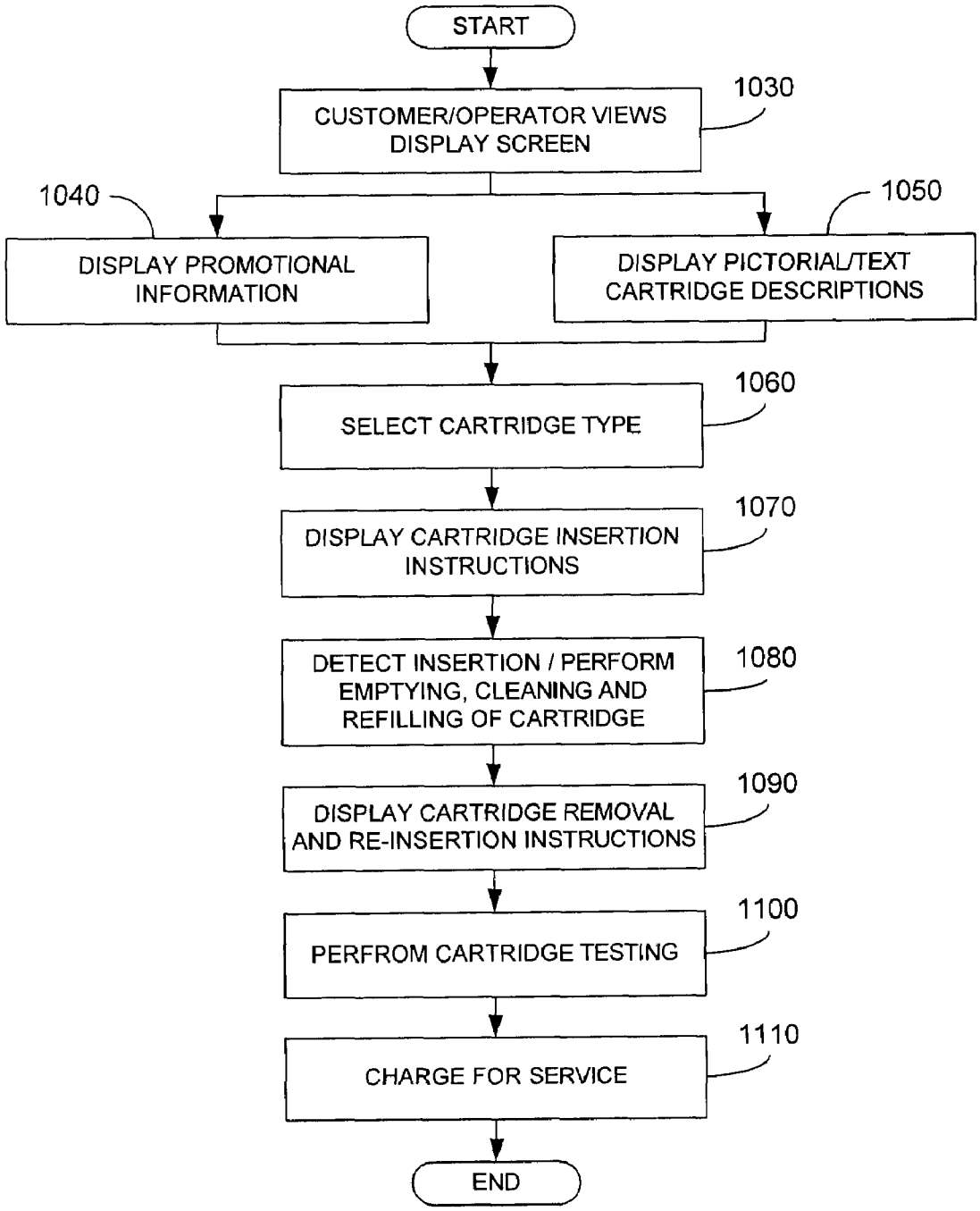
FIG. 10 is a flow chart of the operation of one embodiment of the inkjet refilling station according to the present invention.

FIG. 10 illustrates a flow chart of another embodiment in accordance with the present invention. In this embodiment, print testing station separate from the cradles used to empty, clean and refill ink cartridges is provided. Thus, beginning at block 1030, a customer or operator, having an empty inkjet cartridge in-hand, views a video display screen on an upper face of the unit. At block 1040, the screen displays promotional information and, at block 1050, displays pictorial/text descriptions of cartridges that can be refilled at the station. Upon matching one of the pictures with the cartridge in hand the operator selects, at block 1060, the area on the display (touch-activated) that represents the match. Thereafter, at block 1070, the display advances to a set of instructions that typically prompt the operator to insert the cartridge into one of several cradles on the face of the machine. At block 1080, the machine detects the insertion and performs an automated process of emptying, cleaning and refilling the cartridge. Upon completion of the emptying, cleaning and refilling process, the display prompts the operator, at block 1090, to remove the cartridge and insert it into a print-testing station where it is tested at block 1100. Upon a satisfactory result, the refilled cartridge is ready for use and the customer is charged, at block 1110, for the service.

Thus, while the invention has been described with respect to certain preferred embodiments, it will be understood by those of skill in the art that there are modifications, substitutions and other changes that can be made, yet will still fall within the intended scope of the invention.

The invention claimed is:

1. An ink cartridge refilling machine, comprising:

a housing;

a display, supported by the housing;

a plurality of cradles, supported by the housing and configured to receive corresponding ink cartridges; and an electronic controller, supported within the housing and in communication with the display and the plurality of cradles, operative to: display, via the display, information concerning ink cartridges that can be refilled by the ink cartridge refilling machine; receive, in response to the display of the information concerning the ink cartridges that can be refilled by the ink cartridge refilling machine, an indication of an ink cartridge to be refilled; and display, via the display and in response to the indication of the ink cartridge to be refilled, information concerning a cradle of the plurality of cradles in which the ink cartridge should be inserted.

2. The ink cartridge filling machine of claim 1, the display comprising a touch screen display operative to provide the indication of the ink cartridge to be refilled.

3. The ink cartridge filling machine of claim 1, each cradle of the plurality of cradles comprising a sensor operative to sense insertion of an ink cartridge therein.

4. The ink cartridge filling machine of claim 1, each cradle of the plurality of cradles comprising means for emptying, cleaning and refilling an ink cartridge inserted therein.

5. The ink cartridge filling machine of claim 1, further comprising:

a print testing station in communication with the electronic controller, wherein the electronic controller is further operative to: display, via the display, instructions to remove the ink cartridge from the cradle and to insert the ink cartridge into the print testing station.

6. An ink cartridge refilling machine, comprising:

an electronic controller;

means, in communication with the electronic controller, for displaying information concerning ink cartridges that can be refilled by the ink cartridge refilling machine;

means, in communication with the electronic controller, for receiving, in response to the information concerning the ink cartridges that can be refilled by the ink cartridge refilling machine, an indication of an ink cartridge to be refilled; and means, in communication with the electronic controller, for displaying, in response to the indication of the ink cartridge to be refilled, information concerning a cradle of a plurality of cradles in which the ink cartridge should be inserted.

7. The ink cartridge refilling machine of claim 6, further comprising:

means, in communication with the electronic controller, for detecting insertion of the ink cartridge in the cradle; and means, in communication with the electronic controller and the cradle, for automatically emptying, cleaning and refilling the ink cartridge.

8. The ink cartridge refilling machine of claim 7, further comprising:

means, in communication with the electronic controller, for displaying instructions to remove the ink cartridge; and means, in communication with the electronic controller, for displaying information concerning a print testing station where the ink cartridge is to be inserted.

9. The ink cartridge refilling machine of claim 8, further comprising:

means, in communication with the electronic controller, for detecting insertion of the ink cartridge in the print testing station; and means, in communication with the electronic controller and the print testing station, for testing the ink cartridge.

10. In an ink cartridge refilling machine comprising a plurality of cradles configured to receive corresponding ink cartridges, a method for operating the ink cartridge refilling machine, the method comprising:

displaying information concerning ink cartridges that can be refilled by the ink cartridge refilling machine;

receiving, in response to displaying the information concerning the ink cartridges that can be refilled by the ink cartridge refilling machine, an indication of an ink cartridge to be refilled; and displaying, in response to the indication of the ink cartridge to be refilled, information concerning a cradle of the plurality of cradles in which the ink cartridge should be inserted.

11. The method of claim 10, further comprising:

detecting insertion of the ink cartridge in the cradle; and automatically emptying, cleaning and refilling the ink cartridge.

12. The method of claim 10, further comprising:

displaying instructions to remove the ink cartridge from the cradle; and displaying information concerning a print testing station where the ink cartridge is to be inserted.

13. The method of claim 12, further comprising:

detecting insertion of the ink cartridge in the print testing station; and testing the ink cartridge.

14. The method of claim 13, further comprising:

charging a customer for refilling the ink cartridge.

* * * * *